US011639620B2

(12) United States Patent
Yoshino

(10) Patent No.: US 11,639,620 B2
(45) Date of Patent: May 2, 2023

(54) VEHICULAR DOOR HANDLE DEVICE

(71) Applicant: AISIN CORPORATION, Kariya (JP)

(72) Inventor: Masaki Yoshino, Kariya (JP)

(73) Assignee: AISIN CORPORATION, Aichi (JP)

( * ) Notice: Subject to any disclaimer, the term of this patent is extended or adjusted under 35 U.S.C. 154(b) by 281 days.

(21) Appl. No.: 16/793,369

(22) Filed: Feb. 18, 2020

(65) Prior Publication Data

US 2020/0270915 A1 Aug. 27, 2020

(30) Foreign Application Priority Data

Feb. 26, 2019 (JP) ..... JP2019-032627

(51) Int. Cl.
*E05B 81/90* (2014.01)
*E05B 81/78* (2014.01)
(Continued)

(52) U.S. Cl.
CPC ..... *E05B 81/90* (2013.01); *E05B 79/06* (2013.01); *E05B 81/14* (2013.01); *E05B 81/16* (2013.01);
(Continued)

(58) Field of Classification Search
CPC ..... E05B 81/12; E05B 81/14; E05B 81/16; E05B 81/18; E05B 81/76; E05B 81/77;
(Continued)

(56) References Cited

U.S. PATENT DOCUMENTS 9,249,606 B2 * 2/2016 Naka ..... E05B 81/78
10,145,152 B2 * 12/2018 Beck ..... E05B 17/14
(Continued)

FOREIGN PATENT DOCUMENTS

DE 102006027473 A1 * 12/2007 ..... E05B 79/20
DE 102006029774 A1 * 1/2008 ..... E05B 81/78
(Continued)

OTHER PUBLICATIONS

U.S. Appl. No. 16/793,114, filed Feb. 18, 2020, Masaki Yoshino.
(Continued)

*Primary Examiner* — Peter M. Cuomo
*Assistant Examiner* — Noah Horowitz
(74) *Attorney, Agent, or Firm* — Buchanan Ingersoll & Rooney PC

(57) ABSTRACT

A vehicular door handle device includes: a main body portion being disposed on an outside surface of a door panel of a vehicle, extending in a predetermined direction, and including a hollow portion in an intermediate portion in the extending direction; a touch sensor being housed in the hollow portion for detecting a change in capacitance, and being connected to a control device that controls an opening mechanism for setting a closed vehicular door in an openable state; a frame portion including a shaft portion that extends in the predetermined direction and rotatably supports the main body portion; and a fixing mechanism for fixing the main body portion to the frame portion. Fixing of the main body portion to the frame portion by the fixing mechanism is temporarily released, and the opening mechanism is configured to be driven by rotating the main body portion.

1 Claim, 9 Drawing Sheets

(51) Int. Cl.

| | |
|---|---|
| ***E05B 81/16*** | (2014.01) |
| ***E05B 85/16*** | (2014.01) |
| ***E05B 79/06*** | (2014.01) |
| ***E05B 85/18*** | (2014.01) |
| ***E05B 81/14*** | (2014.01) |

(52) U.S. Cl.
CPC ..... *E05B 81/78* (2013.01); *E05B 85/16* (2013.01); *E05B 85/18* (2013.01)

(58) Field of Classification Search
CPC ..... E05B 81/78; E05B 81/90; E05B 79/06; E05B 79/12; E05B 79/16; E05B 79/18; E05B 85/10; E05B 85/14; E05B 85/16; E05B 85/18; Y10T 292/57
See application file for complete search history.

(56) References Cited

U.S. PATENT DOCUMENTS

| | | | | |
|---|---|---|---|---|
| 10,980,660 | B2 * | 4/2021 | Richardson | A61F 5/3792 |
| 11,174,663 | B2 * | 11/2021 | Gerber | E05B 81/90 |
| 2017/0159332 | A1 | 6/2017 | Beck | |
| 2019/0024422 | A1 * | 1/2019 | Inan | E05B 77/12 |
| 2020/0270914 | A1 | 8/2020 | Yoshino | |
| 2021/0025203 | A1 * | 1/2021 | Bendel | E05B 81/90 |

FOREIGN PATENT DOCUMENTS

| | | | | |
|---|---|---|---|---|
| DE | 102007052248 | A1 * | 6/2008 | E05B 77/48 |
| JP | 2010024802 | A | 2/2010 | |
| JP | 2012129762 | A | 7/2012 | |
| WO | WO-2017129333 | A1 * | 8/2017 | E05B 81/76 |
| WO | WO-2020144453 | A1 * | 7/2020 | E05B 81/76 |

OTHER PUBLICATIONS

Office Action (Notice of Reasons for Refusal) dated Aug. 24, 2022, by the Japan Patent Office in corresponding Japanese Patent Application No. 2019-032627 and an English Translation of the Office Action. (5 pages).

* cited by examiner

VEHICULAR DOOR HANDLE DEVICE

CROSS REFERENCE TO RELATED APPLICATIONS

This application is based on and claims priority under 35 U.S.C. § 119 to Japanese Patent Application 2019-032627, filed on Feb. 26, 2019, the entire content of which is incorporated herein by reference.

TECHNICAL FIELD

This disclosure generally relates to a vehicular door handle device.

BACKGROUND DISCUSSION

A vehicular door lock device generally includes a latch mechanism for engaging with a striker provided on an edge portion of an opening (for example, an entrance) of a vehicle main body, and keeping a vehicular door in a closed state. Furthermore, the vehicular door lock device includes a release mechanism for releasing engagement between the latch mechanism and the striker. The release mechanism is coupled to a handle portion of a vehicular door handle device via a link mechanism (such as a rod and a cable). The handle portion is rotatably supported about a predetermined shaft member on a door panel. In a state where the latch mechanism and the striker engage with each other, when a user pulls the handle portion toward the user, the handle portion rotates with respect to the door panel. Then, the rotating operation is transmitted to the release mechanism via the link mechanism, and the engagement between the latch mechanism and the striker is released. In other words, the vehicular door is brought into an openable state. Further, the vehicular door lock device including an electric actuator that drives the release mechanism is also known.

Furthermore, the vehicular door lock device generally includes a lock/unlock mechanism. The lock/unlock mechanism switches a state (unlock state) where the link mechanism and the release mechanism engage with each other and a state (lock state) where the engagement between the link mechanism and the release mechanism is released. The lock/unlock mechanism is coupled to a door lock knob. Further, the vehicular door lock device including an electric actuator that drives the lock/unlock mechanism is also known.

The electric actuator described above is controlled by a control device (ECU) of the vehicle. The control device controls the electric actuator, based on an output signal of a sensor provided on the vehicular door handle device.

For example, JP 2012-129762A (Reference 1) discloses a vehicular door handle including a touch sensor that detects a change in capacitance. The touch sensor is connected to a control device (ECU) of a vehicle. The control device controls an electric actuator that drives a lock/unlock mechanism of a vehicular door lock device, based on an output signal (signal according to a change in capacitance) of the touch sensor.

The control device may also control an electric actuator that drives a release mechanism of the vehicular door lock device, based on an output signal of the touch sensor. In this case, when a user touches a detection region of the touch sensor on an outer surface of a handle portion, the touch sensor outputs a signal according to a change in capacitance. The control device activates the electric actuator, based on the output signal of the touch sensor, releases engagement between a latch and a striker, and brings a vehicular door into an openable state. Then, when the user pulls the handle portion toward the user in this state, the vehicular door opens.

In order to activate the electric actuator, predetermined electric power needs to be supplied to the electric actuator from a power source device (battery) of a vehicle. In a state where sufficient electric power can be supplied to the electric actuator, the electric actuator drives the release device only by a touch on the touch sensor by a user, and engagement between the latch mechanism and the striker is released. Therefore, this case does not need a structure that rotates the handle portion with respect to a door panel, and a link mechanism for coupling the handle portion and the release mechanism to each other. Furthermore, in a state where the engagement between the latch mechanism and the striker is released by the electric actuator, the vehicular door opens more easily when the handle portion is fixed to the door panel than when the handle portion is rotatably supported with respect to the door panel.

However, when electric power supplied to the electric actuator from the power source device is insufficient, the electric actuator is failed to be appropriately activated. In other words, the engagement between the latch mechanism and the striker is not released only by a touch on the touch sensor by a user. Thus, in this case, the release mechanism needs to be activated via the link mechanism by rotating the handle portion with respect to the door panel.

A need thus exists for a vehicular door handle device which is not susceptible to the drawback mentioned above.

SUMMARY

A vehicular door handle device according to this disclosure includes a main body portion, a sensor, a frame portion, and a fixing mechanism. The main body portion is disposed on an outside surface of a door panel of a vehicle, extends in a predetermined direction, and includes a hollow portion in an intermediate portion in the extending direction. The sensor is housed in the hollow portion, detects a change in capacitance, and is connected to a control device that controls an opening mechanism for setting a closed vehicular door in an openable state. The frame portion includes a shaft portion that extends in the predetermined direction and rotatably supports the main body portion. The fixing mechanism fixes the main body portion to the frame portion. Fixing of the main body portion to the frame portion by the fixing mechanism is temporarily released, and the opening mechanism is configured to be driven by rotating the main body portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

A first embodiment disclosed here will be explained with reference to the attached drawings.

Note that, in the following description of each component of this disclosure, reference signs of corresponding components and parts in an embodiment is described in parentheses in order to facilitate understanding of this disclosure. However, each component of this disclosure should not be limited to a configuration of the corresponding components and parts indicated by the reference sign in the embodiment for interpretation.

Figure 1:
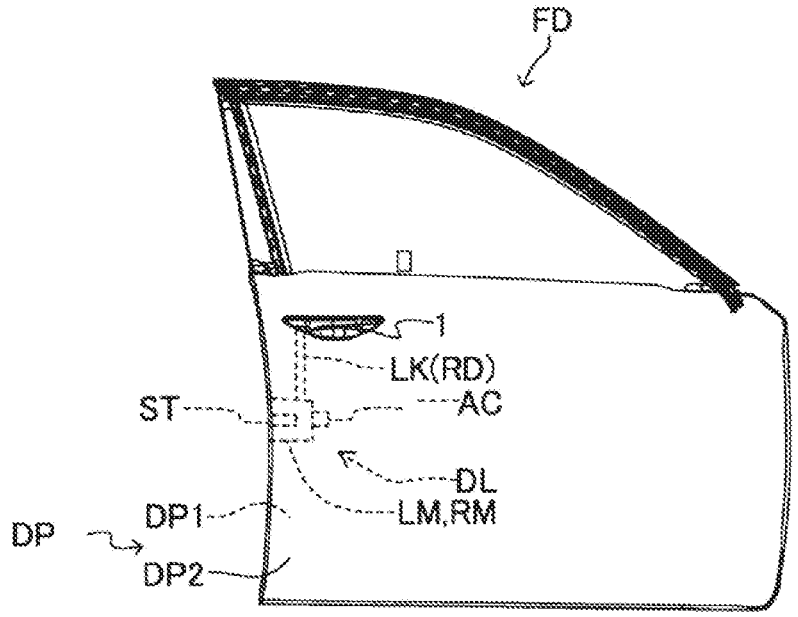
FIG. 1 is a schematic diagram of a front door to which a door handle device according to one embodiment of this disclosure is applied.

A door handle device 1 according to an embodiment of this disclosure will be described below. First, an outline of a front door FD (see FIG. 1) to which the door handle device 1 is applied will be described. The front door FD is attached to a right entrance of a vehicle, for example. A front end surface of the front door FD is assembled to the entrance provided on a side surface portion of a main body portion of the vehicle via a hinge(s) (not illustrated). The front door FD rotates about a shaft of the hinge(s), and opens and closes the entrance of the vehicle. Various directions in the following description represent directions in a state where the front door FD is closed. Note that this embodiment is an example of applying the door handle device 1 to the right front door FD of the vehicle, but the door handle device 1 is also applicable to another door.

The front door FD includes a door panel DP. The door panel DP is provided with an inner panel DP1 (compartment inner side panel) and an outer panel DP2 (compartment outer side panel). Outer circumferential portions of the inner panel DP1 and the outer panel DP2 are bonded to each other. The inner panel DP1 and the outer panel DP2 are press-molded in advance into a shape including space formed between the inner panel DP1 and the outer panel DP2, in the state where the outer circumferential portions of the inner panel DP1 and the outer panel DP2 are bonded to each other. In other words, the door panel DP is a box-shaped part (or a bag-shaped part).

A door lock device DL and the door handle device 1 are attached to the door panel DP. The door lock device DL is disposed on a rear end surface in the door panel DP. The door lock device DL includes a latch mechanism LM for engaging with a striker ST provided on a circumferential portion of the entrance of the vehicle, and holding the state where the front door FD is closed. A part of the latch mechanism LM is exposed from an opening provided in the rear end surface of the door panel DP. When the front door FD is closed, the striker ST enters the door panel DP through the opening, and the latch mechanism LM and the striker ST engage with each other.

Furthermore, the door lock device DL includes a release mechanism RM (open mechanism) for releasing the engagement between the latch mechanism LM and the striker ST. The release mechanism RM includes a lever, a link member, and the like that engage with the latch mechanism LM. Furthermore, the door lock device DL includes an electric actuator AC that drives the release mechanism RM (that rotates or moves the lever, the link member, and the like). The electric actuator AC is connected to a control device of the vehicle via a cable (not illustrated). The control device includes a microcomputer and an electric power supply device to the electric actuator AC. Furthermore, the release mechanism RM is coupled to the door handle device 1 described later via a link mechanism LK (for example, a rod RD extending in a vehicle height direction). As described later in detail, the release mechanism RM is normally driven by the electric actuator AC. When a malfunction occurs in the electric actuator AC or the control device, the release mechanism RM is driven by the door handle device 1 and the link mechanism LK.

A recessed portion RP being slightly recessed toward a left side (door panel DP inner side) is formed in a portion that is a rear portion of the outer panel DP2 and is located above the door lock device DL. An anteroposterior pair of openings (through holes) OP and OP (see FIG. 2 as well as FIGS. 6 and 7) are provided in the recessed portion RP. The door handle device 1 is attached to the recessed portion RP.

As illustrated in FIGS. 2 to 7, the door handle device 1 includes a frame portion 10, a handle portion 20, a touch sensor 30, and a fixing pin 40.

Figure 2:
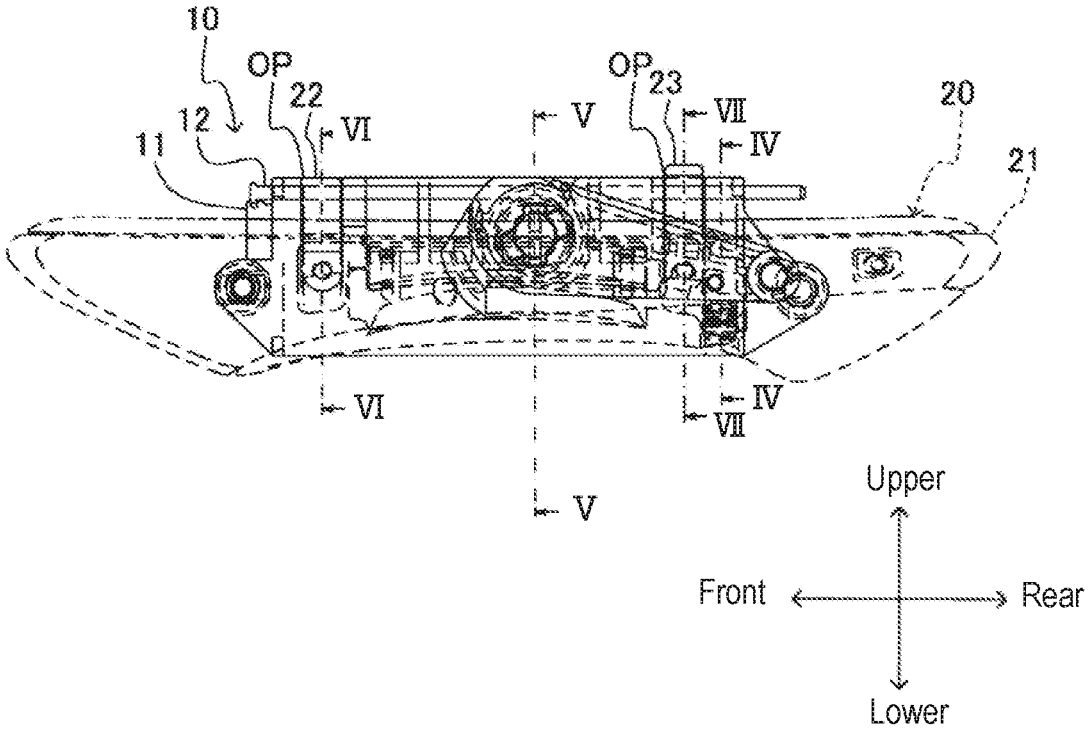
FIG. 2 is a front view when the door handle device in FIG. 1 is seen from a compartment inner side.

The frame portion 10 is disposed in the door panel DP. As illustrated in FIG. 2, the frame portion 10 includes a support body 11 and a shaft 12. The support body 11 is attached to a left side surface of the recessed portion RP (inside surface of the door panel DP).

Figure 4:
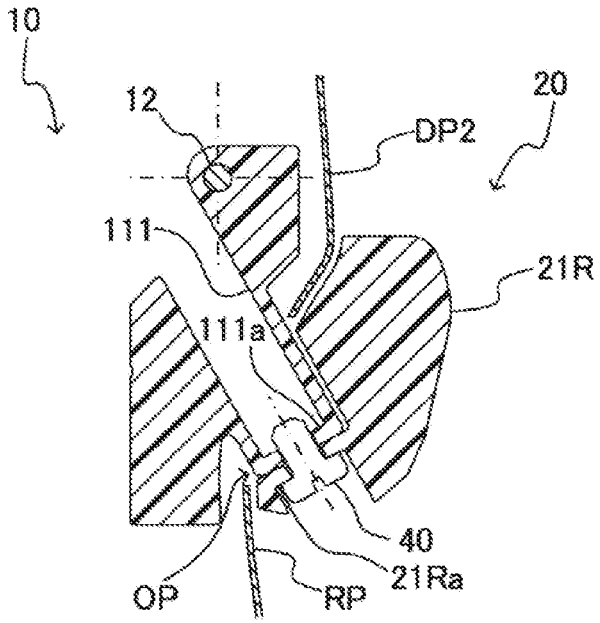
FIG. 4 is a cross-sectional view taken along a IV-IV line in FIG. 2.

As illustrated in FIG. 4, a tube portion 111 is formed on a rear portion of the support body 11. A central axis of the tube portion 111 is inclined in such a way that a lower end side thereof is located closer to the right than an upper end side. A slit $S_{111a}$ extending in a vehicle anteroposterior direction is formed in a bottom wall portion 111*a* of the tube portion 111 (see FIG. 15). A lower end portion of the tube portion 111 protrudes from the opening OP provided in the outer panel DP2 toward the outside of the door panel DP.

Figure 6:
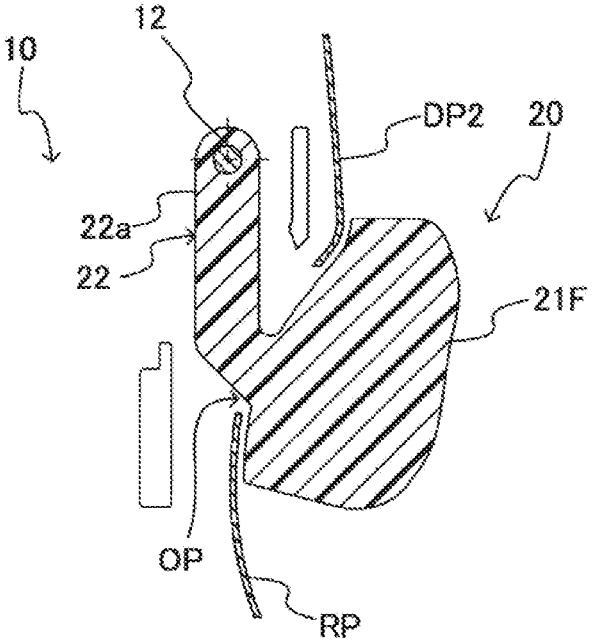
FIG. 6 is a cross-sectional view taken along a VI-VI line in FIG. 2.
Figure 7:
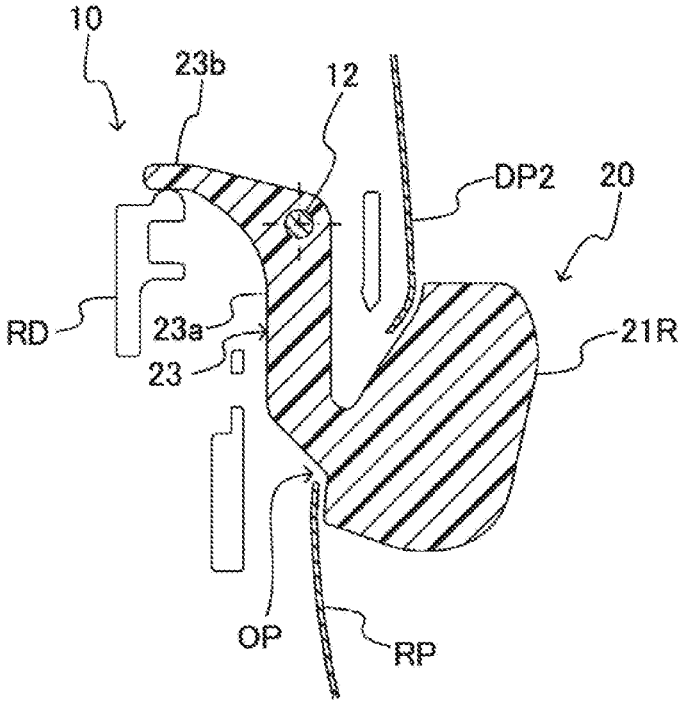
FIG. 7 is a cross-sectional view taken along a VII-VII line in FIG. 2.

The shaft 12 extends in the vehicle anteroposterior direction slightly above and slightly on the left (inner panel DP1 side) when seen from the openings OP and OP, and is supported by the support body 11 (see FIG. 2 as well as FIGS. 6 and 7).

As described later in detail, the handle portion 20 is supported rotatably about the shaft 12, but the handle portion 20 is normally fixed to the frame portion 10 by the fixing pin 40. Various directions in the following description of the configuration of the handle portion 20 are directions in a state where the handle portion 20 is fixed to the frame portion 10.

Figure 3:
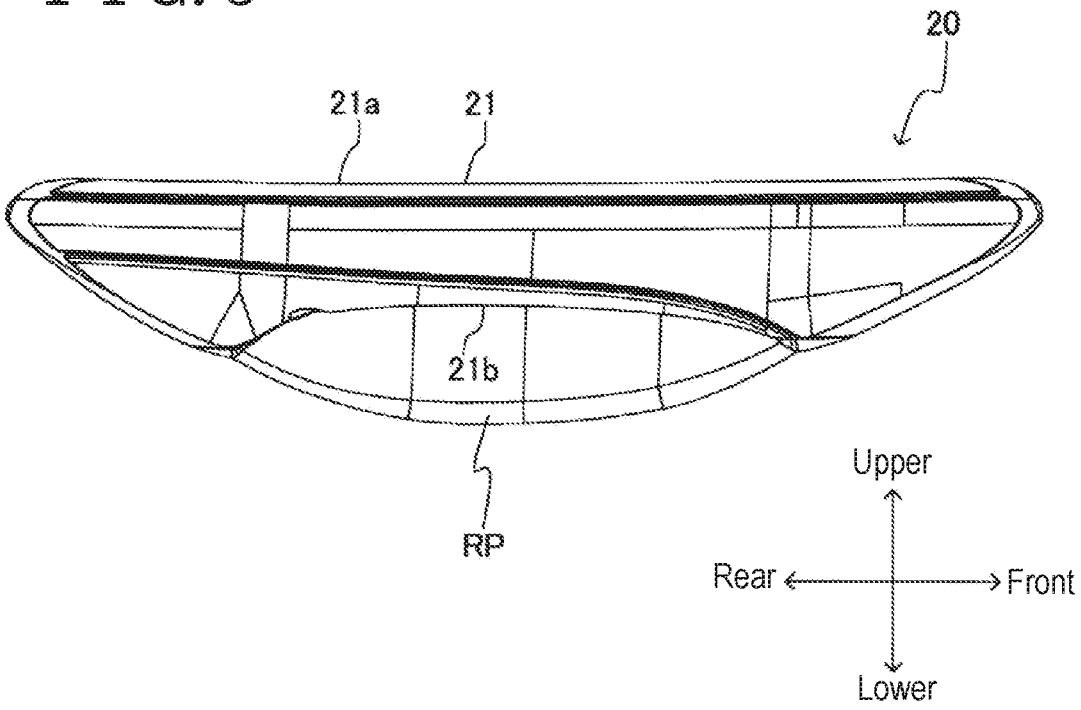
FIG. 3 is a front view when the door handle device in FIG. 1 is seen from a compartment outer side.

Next, the configuration of the handle portion 20 will be described. The handle portion 20 includes a main body portion 21 and an anteroposterior pair of arm portions 22 and 23 (see FIGS. 2 and 3). The main body portion 21 extends in the vehicle anteroposterior direction. The main body portion 21 is disposed on a right surface of the recessed portion RP (outside surface of the outer panel DP2). The main body portion 21 is disposed in an upper half portion of the recessed portion RP. When seen from the right of the front door FD, the main body portion 21 has a trapezoid that is a substantially trapezoid extending in the vehicle anteroposterior direction and has an upper bottom side 21*a* longer than a lower bottom side 21*b* (see FIG. 3). In FIG. 3, the upper bottom side 21*a* is linear, but the lower bottom side 21*b* is curved in such a way that a central portion thereof is slightly located closer to the top than both end portions.

Figure 5:
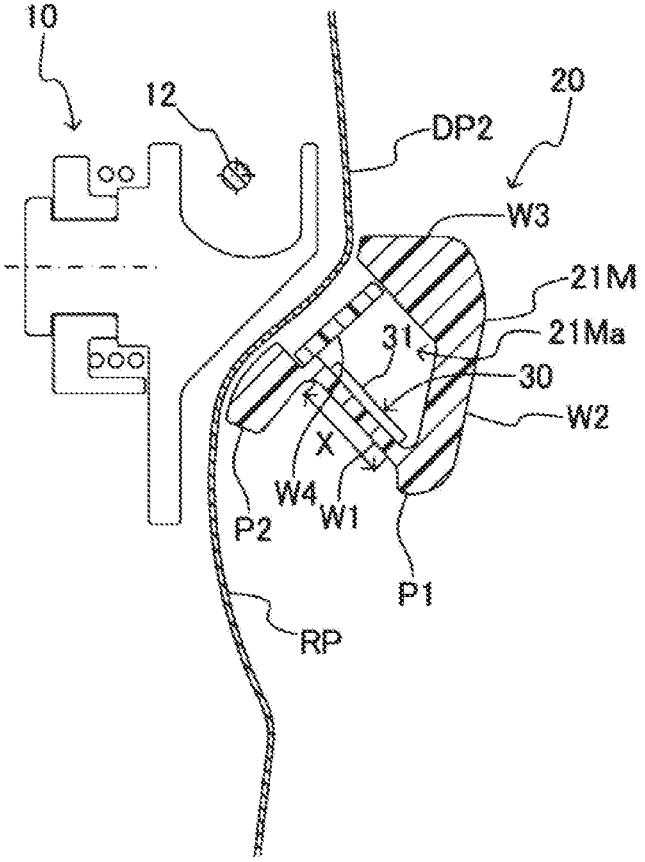
FIG. 5 is a cross-sectional view taken along a V-V line in FIG. 2.

As illustrated in FIG. 5, a hollow portion 21Ma is provided in an intermediate portion 21M in an extending direction (vehicle anteroposterior direction) of the main body portion 21. As illustrated in FIG. 4, the hollow portion 21Ma is a space surrounded by a bottom wall portion W1, an outer wall portion W2, an upper wall portion W3, and an inner wall portion W4.

The bottom wall portion W1 is a flat plate portion extending in the vehicle anteroposterior direction. The bottom wall portion W1 is disposed in such a way that one end portion in a width direction (direction perpendicular to a plate thickness direction and the vehicle anteroposterior direction) thereof is located closer to the bottom than the other end portion. In other words, the plate thickness direction of the bottom wall portion W1 is inclined to the vehicle height direction and a vehicle width direction.

The outer wall portion W2 is a flat plate portion that extends upward from a right end portion of the bottom wall portion W1 and also extends in the vehicle anteroposterior direction.

The upper wall portion W3 extends leftward from an upper end portion of the outer wall portion W2 and also extends in the vehicle anteroposterior direction. The upper wall portion W3 has a substantially right triangle in a section of the intermediate portion 21M perpendicular to the vehicle anteroposterior direction. In the section, a sharp portion (one corner portion) of the upper wall portion W3 is directed toward the left.

The inner wall portion W4 is a flat plate portion extending in the vehicle anteroposterior direction. The inner wall portion W4 is disposed substantially perpendicular to the bottom wall portion W1.

The bottom wall portion W1, the outer wall portion W2, and the upper wall portion W3 are integrally formed. The inner wall portion W4 is different from the bottom wall portion W1, the outer wall portion W2, and the upper wall portion W3. A space being surrounded by the bottom wall portion W1, the outer wall portion W2, and the upper wall portion W3 and open obliquely upward to the left is formed, and the opening is closed with the upper wall portion W4.

A protruding portion P1 protruding downward is formed on a connection portion (corner portion) between the bottom wall portion W1 and the outer wall portion W2. Further, a protruding portion P2 protruding obliquely downward to the left is formed on a connection portion (corner portion) between the bottom wall portion W1 and the inner wall portion W4. The protruding portion P1 and the protruding portion P2 extend in the vehicle anteroposterior direction along both end portions in the width direction of the bottom wall portion W1.

Furthermore, the main body portion 21 includes a plate portion 21Ra protruding obliquely downward to the left from a lower portion of a left surface of a rear portion 21R thereof (see FIG. 4). The plate portion 21Ra overlaps with an outside surface of the bottom wall portion 111*a* of the tube portion 111. A slit $S_{21Ra}$ extending in the vehicle anteroposterior direction is formed in the plate portion 21Ra. The slit $S_{21Ra}$ and the slit $S_{111a}$ overlap and communicate with each other. The slit $S_{21Ra}$ and the slit $S_{111a}$ have the same width and length.

As illustrated in FIGS. 6 and 7, the arm portions 22 and 23 extend leftward and upward from a left surface of the main body portion 21. The arm portions 22 and 23 include support arm portions 22*a* and 23*a* that are inserted into the door panel DP from the openings OP and OP and are supported by the shaft 12. Tip end portions of the support arm portions 22*a* and 23*a* are supported rotatably about the shaft 12. The support arm portions 22*a* and 23*a* are biased by a torsion coil spring (not illustrated) in a clockwise direction in FIGS. 6 and 7. The main body portion 21 abuts an outside surface of the recessed portion RP, and the handle portion 20 is at rest. Furthermore, the arm portion 23 includes a crank arm portion 23*b* extending leftward from the tip end portion of the support arm portion 23*a*.

The touch sensor 30 is housed in the hollow portion 21Ma. The touch sensor 30 includes a detection unit 31 that detects a change in capacitance (see FIG. 5). The detection unit 31 is a rectangular plate-shaped portion extending in the vehicle anteroposterior direction. The detection unit 31 has a width and a length smaller than a width and a length of the bottom wall portion W1. The detection unit 31 overlaps with and is fixed to an upper surface of the bottom wall portion W1 (inside surface of the hollow portion 21Ma). The detection unit 31 detects a change in capacitance of an outside surface of the bottom wall portion W1. The touch sensor 30 outputs a signal according to the change in capacitance. A region that is the outside surface of the bottom wall portion W1 and allows the detection unit 31 to detect a change in capacitance is referred to as a detection region X. Note that, after the touch sensor 30 is attached to the bottom wall portion W1, the inner wall portion W4 is attached. A circumferential portion of the inner wall portion W4 (such as a boundary portion between the inner wall portion W4 and the bottom wall portion W1 and a boundary portion between the inner wall portion W4 and the bottom wall portion W1) is sealed by using a seal member (not illustrated). The touch sensor 30 is connected to a microcomputer of the control device of the vehicle via a cable (not illustrated). When a user touches the outside surface of the bottom wall portion W1, a capacitance of the detection unit 31 changes. The touch sensor 30 supplies a signal according to the change in capacitance to the control device.

Figure 8:
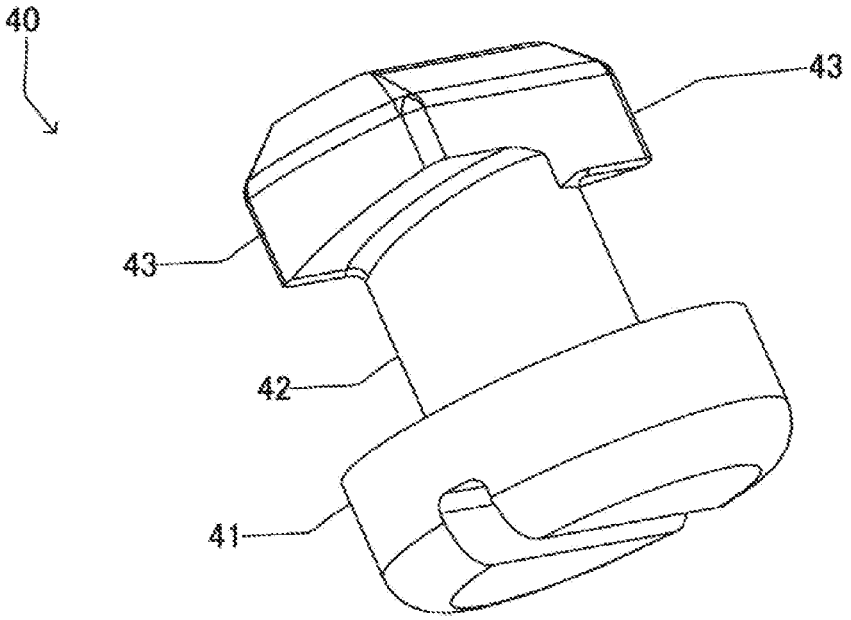
FIG. 8 is a perspective view of a fixing pin.
Figure 9:
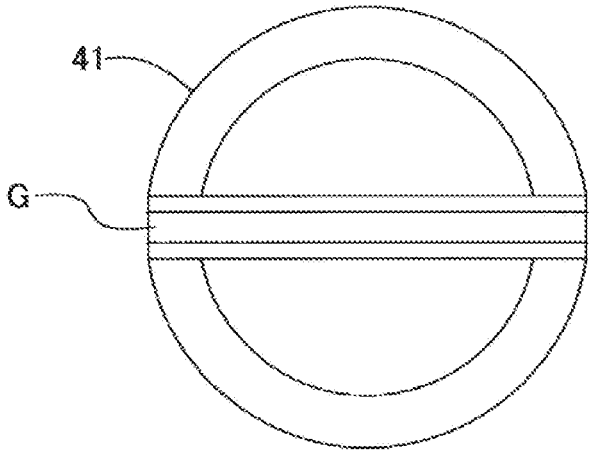
FIG. 9 is a bottom view of the fixing pin.
Figure 10:
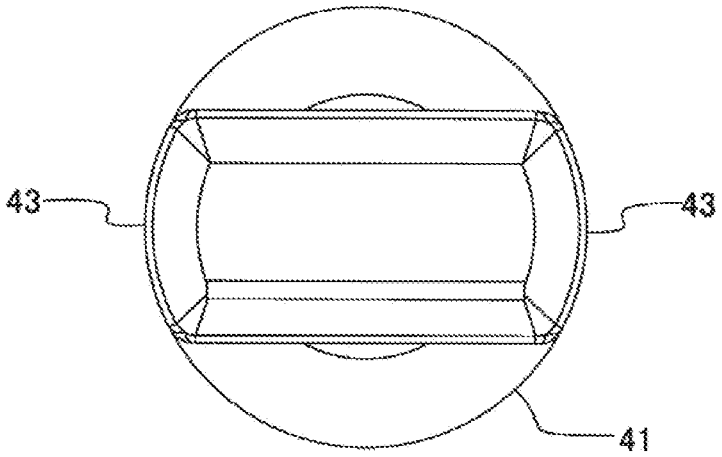
FIG. 10 is a plan view of the fixing pin.
Figure 11:
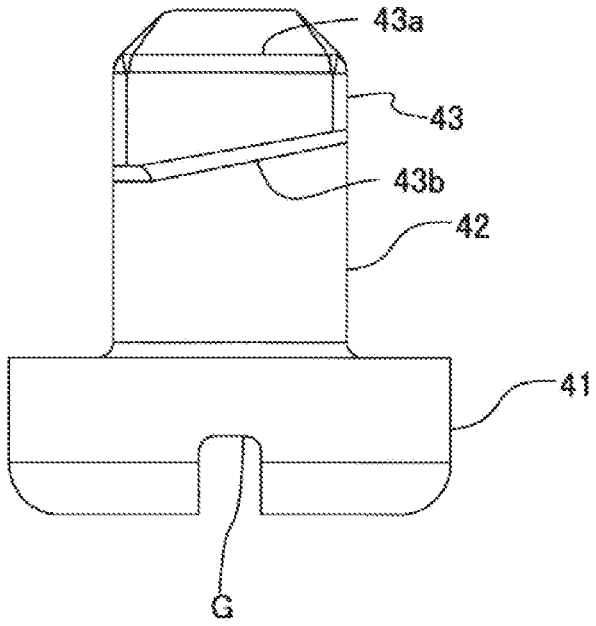
FIG. 11 is a side view of the fixing pin.

As illustrated in FIG. 8, the fixing pin 40 includes a head portion 41, a shaft portion 42, and a pair of flange portions 43 and 43. As illustrated in FIG. 9, the head portion 41 is formed into a disk shape. A linear groove G passing through a central portion is formed in one of side surfaces of the head portion 41. The shaft portion 42 is formed on a central portion of the other side surface of the head portion 41. The shaft portion 42 extends in a plate thickness direction of the head portion 41. As illustrated in FIGS. 10 and 11, the flange portions 43 and 43 are rectangular plate-shaped portions each protruding in a diameter direction of the shaft portion 42 from a tip end portion of the shaft portion 42. One flange portion 43 and the other flange portion 43 are offset by 180° in the diameter direction of the shaft portion 42. As illustrated in FIG. 11, the flange portion 43 is formed into a wedge shape. In other words, a side surface portion 43*a* located opposite to the head portion 41 is perpendicular to an extending direction of the shaft portion 42, and a side surface portion 43*b* located on the head portion 41 side is inclined to the side surface portion 43*a*. More specifically, when the flange portion 43 is seen from an outer peripheral side of the fixing pin 40, a left end of the side surface portion 43*b* is located above a right end. In other words, in FIG. 11, a plate thickness of the flange portion 43 gradually increases from the right end of the flange portion 43 toward the left end. A diameter of the shaft portion 42 and a width of the flange portions 43 and 43 are slightly smaller than a width of the slit $S_{21Ra}$ and the slit $S_{111a}$. A distance between a tip end surface in an extending direction of one flange portion 43 and a tip end surface in an extending direction of the other flange portion 43 is slightly smaller than a length of the slit $S_{21Ra}$ and the slit $S_{111a}$.

Figure 12:
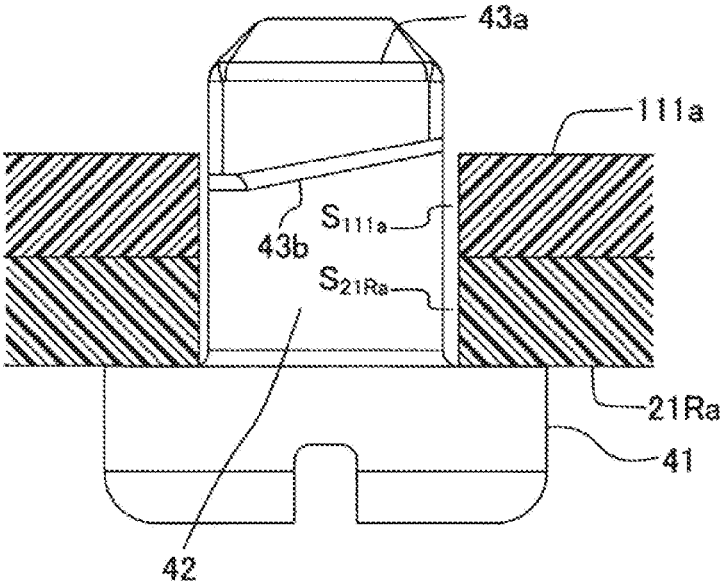
FIG. 12 is a cross-sectional view illustrating a state where the fixing pin is inserted in a slit of a handle portion and a frame portion.
Figure 13:
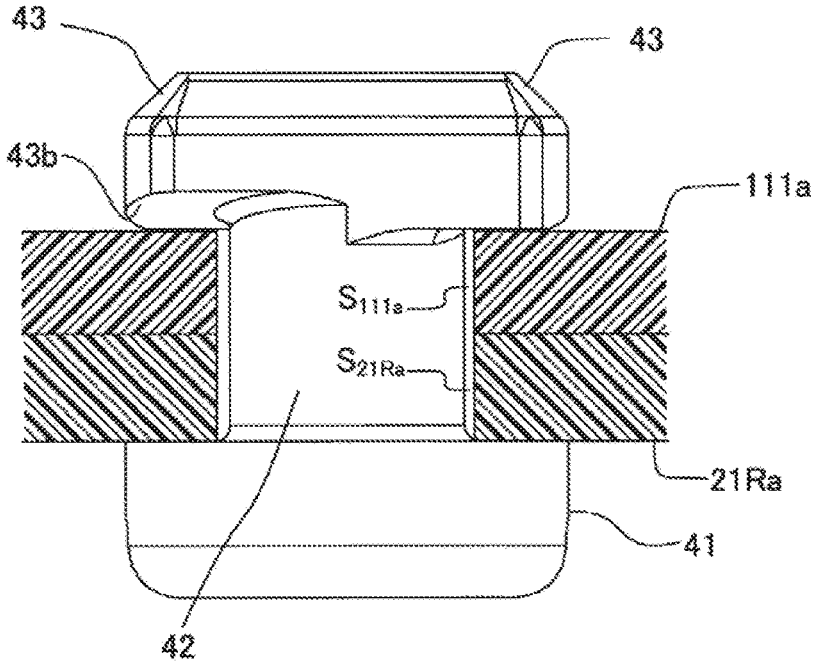
FIG. 13 is a cross-sectional view illustrating a state where the fixing pin in FIG. 12 is rotated 90° and fixes the handle portion and the frame portion.

A tip end portion of the fixing pin 40 is inserted in the slit $S_{21Ra}$ and the slit $S_{111a}$ from below the plate portion 21Ra. As illustrated in FIG. 12, in a state where the head portion 41 of the fixing pin 40 abuts an outside surface of the plate portion 21Ra, end portions on a thin-walled portion side (sharp portion side) of the flange portions 43 and 43 are located in the tube portion 111, but end portions on a thick-walled portion side of the flange portions 43 and 43 are located outside the tube portion 111. A predetermined tool is inserted in the groove portion G, and the fixing pin 40 is rotated 90° in the clockwise direction when seen from one side surface portion side of the head portion 41 by using the tool. In this way, as illustrated in FIG. 13, the shaft portion 42 rotates while becoming elastically deformed so as to slightly extend, and the entire flange portions 43 and 43 enter the tube portion 111. In such a manner, the flange portions 43 and 43 engage with a circumferential portion of the slit $S_{111a}$. In this way, the handle portion 20 is fixed to the frame portion 10. In other words, the rotation of the handle portion 20 about the shaft 12 is regulated.

As described above, the bottom wall portion 111*a* and the plate portion 21Ra are sandwiched between the head portion 41 and the flange portions 43 and 43. In this state, the shaft portion 42 is elastically deformed so as to extend. Thus, the flange portions 43 and 43 are pulled toward the bottom wall portion 111*a* side by the shaft portion 42, and the side surface portions 43*a* and 43*b* of the flange portions 43 and 43 are pressed against the bottom wall portion 111*a*. Further, the head portion 41 is pulled toward the plate portion 21Ra side by the shaft portion 42, and the head portion 41 is pressed against the plate portion 21Ra. Thus, the fixing pin 40 is prevented from rotating due to an impact when the front door FD is open and closed, vibration during traveling of the vehicle, and the like and then falling off the frame portion 10 and the handle portion 20.

Note that, as illustrated in FIG. 4, in a state where the handle portion 20 is fixed to the frame portion 10 by the fixing pin 40, a lower end of the main body portion 21 is located slightly below a lower end of the fixing pin 40. Therefore, when the handle portion 20 of the front door FD is seen, the fixing pin 40 is not visually recognized. Thus, an excellent aesthetic appearance of the side surface portion of the vehicle is maintained.

In the door handle device 1 configured as described above, the protruding portions P1 and P2 protruding downward are formed on the both end portions in the width direction of the bottom wall portion W1. In other words, the protruding portions P1 and P2 each protrude downward farther than one end portion and the other end portion in the width direction of the detection region X of the touch sensor 30. For example, when a raindrop flows on the outer wall portion W2 or the inner wall portion W4 of the main body portion 21 and flows downward in rain, the raindrop accumulates to a certain extent on the tip end portions of the protruding portions P1 and P2 by action of its surface tension, and then falls due to its own weight. In other words, the protruding portions P1 and P2 regulate the raindrop flowing to the outside surface (detection region X) of the bottom wall portion W1 from the outer wall portion W2 or the inner wall portion W4. Thus, the raindrop is less likely to adhere to the bottom wall portion W1, and activation of the electric actuator AC by mistake by the control device can be suppressed.

Further, when a user touches the outside surface of the bottom wall portion W1 in the state where the front door FD is closed, a capacitance of the detection unit 31 changes, and a signal according to the change in capacitance is supplied to the control device from the touch sensor 30. The control device supplies electric power to the electric actuator AC of the door lock device DL, based on the signal supplied from the touch sensor 30, and activates the electric actuator AC. In this way, the release mechanism RM is driven, and the engagement between the latch mechanism LM and the striker ST is released. In other words, the front door FD is in an openable state. When a user pulls the handle portion 20 toward the user, the front door FD opens. At this time, the handle portion 20 is fixed to the frame portion 10, and thus the user can easily pull the handle portion 20 toward the user.

Figure 14:
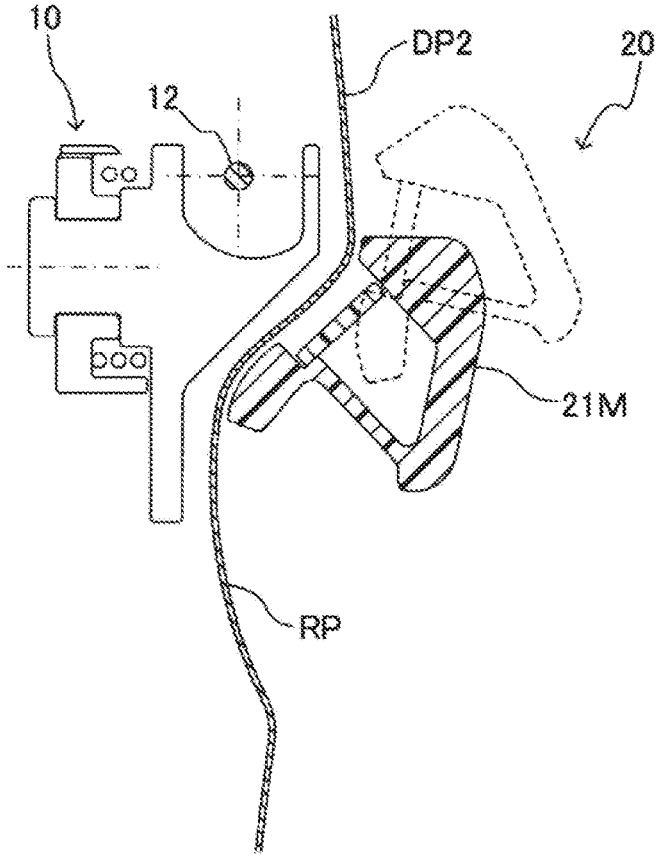
FIG. 14 is a cross-sectional view illustrating a rotating operation of an intermediate portion of the handle portion.
Figure 15:
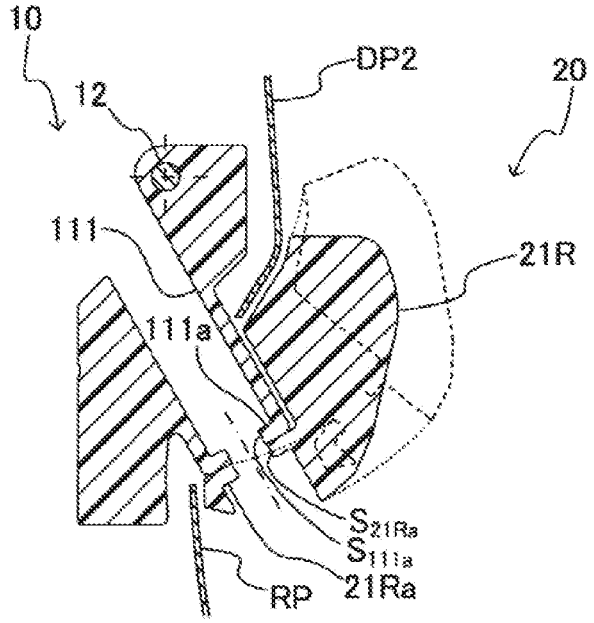
FIG. 15 is a cross-sectional view illustrating a rotating operation of a rear portion (a IV-IV portion in FIG. 2) of the handle portion.
Figure 16:
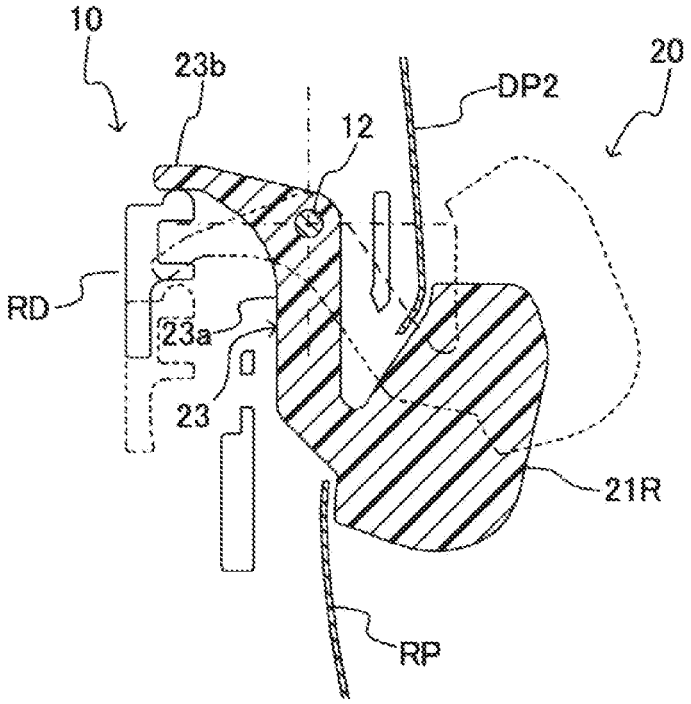
FIG. 16 is a cross-sectional view illustrating a rotating operation of a rear portion (a VII-VII portion in FIG. 2) of the handle portion.

There is a case where a malfunction (for example, a state of an extremely small charge amount of a battery of the vehicle) occurs in the touch sensor 30, the electric actuator AC, or the control device, and the electric actuator AC does not operate even when a user touches the bottom wall portion W1. In case of such malfunction, the user rotates the fixing pin 40 90° counterclockwise by using a predetermined tool, and removes the fixing pin 40 from the frame portion 10 and the handle portion 20. Then, as illustrated in FIGS. 14 to 16, the handle portion 20 is rotated about the shaft 12 by pulling up a lower end portion of the handle portion 20 toward the front. Then, the rod RD is pushed downward by the crank arm portion 23*b*. In this way, the release mechanism RM is driven by the link mechanism LK, and the engagement between the latch mechanism LM and the striker ST is released.

Note that the shaft 12 is disposed closer to the right than a line extending from a central axis line of the tube portion 111 in such a way that a track of the plate portion 21Ra when the handle portion 20 is rotated is not superimposed on the corner portion of the tube portion 111.

Furthermore, the implementation of this disclosure is not limited to the embodiment described above, and various modifications can be made without departing from the purpose of this disclosure.

Figure 17:
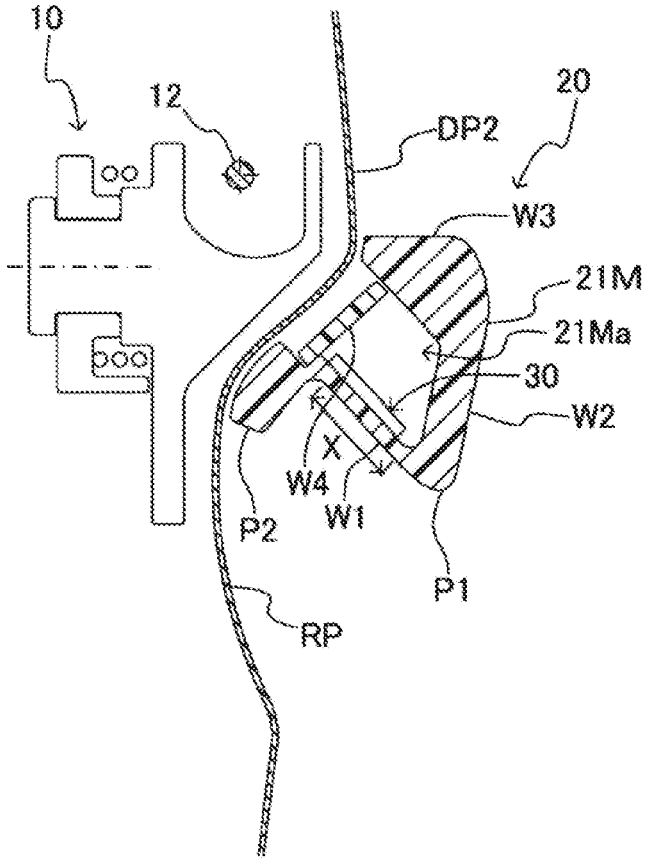
FIG. 17 is a cross-sectional view of an intermediate portion of a handle portion including a protruding portion according to a modification example of this disclosure.

For example, as illustrated in FIG. 17, the outside surface of the protruding portion P1 may be constituted with a portion extending obliquely downward to the right from the outside surface of the bottom wall portion W1 and a portion extending downward from the outside surface of the outer wall portion W2. Further, for example, a nut may be disposed in the tube portion 111, and the handle portion 20 may be fixed to the frame portion 10 by using a screw instead of the fixing pin 40.

A vehicular door handle device according to this disclosure includes a main body portion, a sensor, a frame portion, and a fixing mechanism. The main body portion is disposed on an outside surface of a door panel of a vehicle, extends in a predetermined direction, and includes a hollow portion in an intermediate portion in the extending direction. The sensor is housed in the hollow portion, detects a change in capacitance, and is connected to a control device that controls an opening mechanism for setting a closed vehicular door in an openable state. The frame portion includes a shaft portion that extends in the predetermined direction and rotatably supports the main body portion. The fixing mechanism fixes the main body portion to the frame portion. Fixing of the main body portion to the frame portion by the fixing mechanism is temporarily released, and the opening mechanism is configured to be driven by rotating the main body portion.

In the vehicular door handle device according to an aspect of this disclosure, the main body portion may include an arm portion extending toward a compartment side. A shaft portion of the frame portion may rotatably support an end portion of the arm portion. The fixing mechanism may include a fixing member that engages with the main body portion and the frame portion from an outside of a vehicle and fixes the main body portion to the frame portion.

In the vehicular door handle device according to an aspect of this disclosure, the fixing member may include a stick-shaped portion. The main body portion and the frame portion may include a communication portion, and the main body portion may be fixed to the frame portion by inserting the stick-shaped portion into the communication portion.

In the vehicular door handle device according to an aspect of this disclosure, the frame portion may include a tubular portion that extends obliquely toward a compartment outer side and downward from a predetermined position in the door panel, and includes a bottom wall portion being perpendicular to the extending direction and having a flat plate shape. The main body portion may include a plate-shaped portion overlapping with an outside surface of the bottom wall portion of the tubular portion. A through hole serving as the communication portion may be provided in the tubular portion and the plate-shaped portion. The through hole and the tubular portion may be disposed coaxially. A shaft portion of the frame portion may extend in a horizontal direction, and a central axis of the shaft portion may be located on a compartment outer side when seen from a central axis of the tubular portion.

When a user touches the hollow portion of the main body portion in a state where the vehicular door is closed, a capacitance in a detection region of the sensor changes, and a signal according to the change in capacitance is supplied to the control device from the sensor. The control device supplies electric power to an electric actuator, based on the signal supplied from the sensor, and activates the electric actuator. In this way, the vehicular door is brought into an openable state. The main body portion is fixed to the frame portion when a user pulls the main body portion toward the user, and thus the user can easily pull a handle portion toward the user.

There is a case where a malfunction (for example, a state of an extremely small charge amount of a battery of the vehicle) occurs in the sensor, the electric actuator, or the control device, and the electric actuator is not activated even when a user touches the hollow portion. In case of such a malfunction, fixing of the main body portion to the frame portion by the fixing mechanism may be released. In this way, the main body portion is rotatable about a shaft portion of the frame portion. A user can open the vehicular door by rotating the main body portion.

According to this disclosure, it is possible to is to provide a vehicular door handle device that is applied to a vehicular door including an electric actuator that drives an open mechanism for setting a closed vehicular door in an openable state, that facilitates an operation of opening the vehicular door under normal circumstances, and that can drive the open mechanism by using a handle portion in an unusual case.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicular door handle device, comprising:

a main body portion being disposed on an outside surface of a door panel of a vehicle, extending in a predetermined direction, and including a hollow portion in an intermediate portion in the predetermined direction;

a sensor being housed in the hollow portion for detecting a change in capacitance, and being connected to a control device that controls an opening mechanism for setting a closed vehicular door in an openable state;

a frame portion including a shaft portion that extends in the predetermined direction and rotatably supports the main body portion including the hollow portion; and a fixing mechanism for fixing the main body portion to the frame portion, wherein fixing of the main body portion to the frame portion by the fixing mechanism is temporarily released, and the opening mechanism is configured to be driven by rotating the main body portion, the main body portion includes an arm portion extending toward a compartment side, the shaft portion of the frame portion rotatably supports an end portion of the arm portion, the fixing mechanism includes a fixing member that engages with the main body portion and the frame portion from an outside of a vehicle and fixes the main body portion to the frame portion, the fixing member includes a stick-shaped portion, the main body portion and the frame portion include a communication portion, and the main body portion is fixed to the frame portion by inserting the stick-shaped portion into the communication portion, the frame portion includes a tubular portion that extends obliquely toward a compartment outer side and downward from a predetermined position in the door panel and includes a bottom wall portion being perpendicular to the predetermined direction and having a flat plate shape, the main body portion includes a plate-shaped portion overlapping with an outside surface of the bottom wall portion of the tubular portion, the plate-shaped portion and the outside surface defining a contact area such that plate-shaped portion and the outside surface are in direct contact over the entire contact area, a through hole serving as the communication portion is provided in the tubular portion and the plate-shaped portion, the through hole and the tubular portion are disposed coaxially, and the shaft portion of the frame portion extends in a horizontal direction, and is located on an outer side of a plane that intersects a central axis of the tubular portion and is parallel to a central axis of the shaft.

* * * * *